United States Patent [19]

Vermeulen et al.

[11] 4,357,407

[45] Nov. 2, 1982

[54] PRODUCTION OF REVERSE READING POSITIVE IMAGES OF A STRAIGHT READING ORIGINAL

[75] Inventors: Leon L. Vermeulen, Herenthout; Albert L. Poot, Kontich; Jozef W. Van den Houte, Edegem, all of Belgium

[73] Assignee: AGFA-Gevaert N.V., Mortsel, Belgium

[21] Appl. No.: 251,079

[22] Filed: Apr. 6, 1981

[30] Foreign Application Priority Data

Oct. 9, 1980 [EP] European Pat. Off. ..... 80200949.8

[51] Int. Cl.[3] ..... G03C 5/54

[52] U.S. Cl. ..... 430/204; 430/244; 430/248

[58] Field of Search ..... 430/204, 244, 248, 5

[56] References Cited

U.S. PATENT DOCUMENTS 3,904,412 9/1975 Serrien et al. ..... 430/204

FOREIGN PATENT DOCUMENTS 964773 7/1964 United Kingdom .

OTHER PUBLICATIONS

Journal of Applied Photographic Engineering, vol. 5, No. 3, Summer 1979, Image Technology, pp. 169–171.

*Primary Examiner*—Richard C. Schilling

*Attorney, Agent, or Firm*—William J. Daniel

[57] ABSTRACT

Process for the production of a reverse reading positive line and/or halftone image suited for use in the production of a lithographic offset printing plate, said process comprising the steps of:

(1) photo-exposing a photographic negative working silver halide emulsion material comprising a negative working silver halide emulsion layer on a transparent film support and an anti-halation layer either between the emulsion layer and the film support or at the side of said support opposite the emulsion layer, the exposure of the emulsion layer occurring through the support and the anti-halation layer in a camera without a reversing optical system, (2) bringing the emulsion layer side of the photographic material into contact with an image-receiving material to form by diffusion transfer processing a visible silver image upon the latter, and (3) separating the photographic material from the image-receiving material.

7 Claims, No Drawings

PRODUCTION OF REVERSE READING POSITIVE IMAGES OF A STRAIGHT READING ORIGINAL

The present invention relates to the production of reverse reading positive images of a straight or regular reading original and the use thereof as intermediate in the production of a lithographic printing plate.

It is known that imaged transparent line and/or halftone intermediates used for producing lithographic plates, in particular with presensitized plates for offset printing, should be placed in the plate exposure step with their image-bearing side in contact with the photosensitive side of the plate in order to obtain maximum resolution and sharpness. Moreover, since in lithographic printing by the offset process the plates must be straight or right reading, the line and/or halftone-intermediates used for the desired contact-exposure as referred to must be reverse or wrong reading as seen from the image-bearing side. Thus depending on the type of lithographic plate employed, namely positive-working or negative-working the line and/or halftone i.e. screened, intermediate copy used should be a reverse-reading, positive or negative image of the original.

As is known in the graphic arts, line and/or halftone images can be made by means of special high contrast silver halide film material and processing of the exposed materials by means of high contrast developers, in particular by infectuous development with formaldehyde-hydroquinone developers.

A reverse reading positive line and/or halftone image for use as an intermediate in the exposure of positive-working lithographic plates can be obtained, from common graphic-arts materials, by first forming a right-reading negative and then copying this negative to form a reverse-reading positive. This involves double exposure and processing. When starting with a continuous tone original, the right-reading negative is formed by exposure, through a screen of the emulsion layer of a negative film material in a camera with reversing optical system provided with an optical reversing means e.g. mirror or prism, followed by the usual processing, and the reverse-reading positive image is formed by exposure of a second negative film material in contact with the right-reading negative image with regular processing.

This procedure of forming a reverse reading positive image, therefore, not only requires a long processing time with expensive processing equipment, but also involves the use of expensive cameras with a reversing optical system. Moreover, exposures with optical reversing means results in reduced image quality compared with direct exposure, due to higher light-scattering. It is known that right-reading negative images can also be obtained by means of a camera without reversing means, by exposing the silver halide emulsion of the negative film material in inverted position to the original, i.e., through the film support instead of directly. In this exposure procedure the exposure occurs through the antihalation coating, usually applied to the rear side of the support, which absorbs exposure light and thus reduces sensitivity, but this can be compensated by slightly increasing the exposure time. Exposure through the support nevertheless reduces screen-dot sharpness.

Line and/or halftone images of high quality can be produced very rapidly by means of the peel apart diffusion transfer reversal (DTR-) process. In this process an appropriate high contrast negative light-sensitive silver halide material is exposed e.g. with a reprographic camera to the positive original, using a screen when the original is a continuous tone original, whereupon the negative material is developed while in contact with an image-receiving material. Upon peeling apart the image-receiving material from the negative silver halide material, the latter carries a negative image of the original, while the former shows a positive image of the original. A thorough explanation of the silver halide complex diffusion transfer reversal process, i.e. DTR-process, need not be given as it is well-known in the art, but for more details, reference can be made to A. Rott. and E. Weyde "Photographic Silver Halide Diffusion Processes" 1972, The Focal Press, London-New York.

Light-sensitive negative silver halide materials and non-light-sensitive image-receiving materials for producing line and/or halftone images according to the silver halide diffusion transfer process have been marketed by Agfa-Gevaert N. V., Mortsel, Belgium under the trade mark COPYPROOF. These diffusion transfer materials offer the advantage of providing rapidly with simple equipment line and/or halftone images. However, for the formation of reverse reading positive line and/or halftone images an expensive camera with reversing mirror or prism still must be used. Indeed, by exposure of the negative material consisting of a high contrast negative silver halide emulsion on a polyethylene-coated paper support with a camera without reversing means, followed by diffusion transfer processing in contact with a receptor material with transparent film support, a direct reading positive is produced in the receptor material which is not suited for obtaining a right reading offset printing plate by the desired contact exposure of a positive working presensitized offset plate as referred to hereinbefore.

It is an object of the present invention to provide a process for the production of reverse reading positive line and/or halftone images of a right reading original by means of the silver halide diffusion transfer process without the use of a process camera with expensive optical reversing means.

According to the present invention a process for the production of a reverse reading positive line and/or halftone image on a transparent film support is provided by the steps of:

(1) photographically exposing a photographic negative working silver halide emulsion material to an original the exposure being effected through a screen for a continuous tone original, (2) bringing the emulsion layer side of the photographic material into contact with an image-receiving material having on a transparent support an image-receiving layer containing developing nuclei in the presence of at least one developing agent, an aqueous alkaline liquid that makes the development of the exposed silver halide take place and of a silver halide complexing agent to effect the transfer by diffusion of silver halide complexes from the photographic material into the image-receiving layer to form a visible silver image therein, and (3) separating the exposed photographic material from the image-receiving material, characterized in that the photographic material comprises a negative working silver halide emulsion layer on a transparent film support and an antihalation layer either between the emulsion layer and the film support or at the side of said support opposite to that carrying the emulsion layer, and the exposure of the silver halide emulsion layer takes place through the material support and the antihalation layer in a camera without reversing optical system.

By "negative working silver halide emulsion material" is understood a material that by photo-exposure and development yields a silver image in correspondence with the photo-exposed area.

Typical features of the diffusion transfer reversal process of the present invention are therefore that the support of the negative material is a transparent film support and that the exposure of the emulsion layer proceeds through the support and the antihalation layer.

The antihalation layer is preferably arranged between the emulsion layer and the support.

In graphic arts material for line and/or halftone image formation according to the conventional negative-positive process of photography the antihalation layer is usually coated on the side of the support opposite to that carrying the emulsion in order to permit easy removal of the antihalation dye(s) during processing and to minimize the effect of these dyes on the emulsion characteristics.

Although in the negative diffusion transfer material for use according to the present invention any antihalation dye or pigment can be used, it is preferred to use in the antihalation layer highly light-absorbing carbon black since the anti-halation layer does not need to be discoloured during processing as does the antihalation layer of the graphic arts negative material referred to above. The use of an antihalation layer coated between the emulsion layer and the support provides a better sharpness and higher fine screen dot rendering than when coated on the rear-side of the support. On using carbon black, there is no risk for a disadvantageous effect of the antihalation layer on the sensitometric characteristics of the emulsion.

The use of carbon black in antihalation layers is known e.g. from the BG-Pat. No. 1,541,303.

Since according to the present invention the exposure of the silver halide emulsion layer has to proceed through the antihalation layer, the optical density of the latter is preferably such that the exposure of the silver halide emulsion layer in a reprographic camera with the usual light sources is still possible within reasonable exposure times. Therefore, the optical density of the antihalation layer is preferably not larger than 0.9 and for sufficient absorption preferably not lower than 0.3. An optical density in the range of 0.6 to 0.5 yields very favourable results.

As already pointed out, the antihalation layer preferably contains non bleachable carbon black, e.g. lampblack, that has preferably an average grain size in the range of 10 to 50 nm and is used preferably in the range of 3 to 50% by weight with respect to a hydrophilic colloid binder which is preferably gelatin.

The support of the photographic material may be any conventional transparent hydrophobic resin film made of, e.g., a cellulose ester or a polyester e.g. polyethylene terephthalate. These supports in the present invention are provided preferably at both sides with a subbing layer to improve the adherence of the hydrophilic colloid coatings.

Suitable subbing layers for that purpose are described, e.g., in the U.S. Pat. Nos. 3,495,984 of Johannes Camiel Vanpoecke, Lodewijk Felix De Keyser and Andre Jan Conix, 3,495,985 of Lodewijk Felix De Keyser, Andre Jan Conix and Joseph Antoine Herbots, both issued Feb. 17, 1970, 3,434,840 of Lodewijk Felix De Keyser, Andre Jan Conix and Lodewijk August Van Dessel, issued Mar. 25, 1969, 3,788,856 of August Jean Van Paesschen, Lucien Janbaptist Van Gossum and Jan Josef Priem, issued Jan. 29, 1974 and United Kingdom Patent Specification No. 1,234,755 filed Sept. 28, 1967 by Gevaert-Agfa N. V.

The thickness of the transparent support is preferably in the range of 0.05 mm to 0.2 mm.

For use in the preparation of reverse reading positive images through the DTR-process, any type of negative working silver halide is suitable for preparing the light-sensitive silver halide emulsion film material, provided the silver halide grains are capable of being developed and complexed in the exposed and non-exposed areas respectively with the rapidity required in diffusion transfer processes.

The silver halide of the emulsions used in the present invention may be any of the usual silver halides but preferably substantially consist of silver chloride e.g. at least 70 mole % of the silver halide is chloride, the remainder being preferably bromide. The average grain-size is usually in the range of 200–300 nm.

In order to obtain a spectral sensitivity in the visible spectrum range (orthochromatic or panchromatic sensitivity), the silver halide is spectrally sensitized with one or more known methine dyes.

The amount of spectral sensitization dyes present per mole of silver halide is e.g. from 0.10 to 60 mg.

The hydrophilic colloid used as binder medium for the silver halide is preferably gelatin.

A suitable coverage of silver halide expressed in g of silver nitrate per sq.m is in the range of 1 g/sq.m to 5 g/sq.m.

The image-receiving material for use according to the present invention has to have a transparent support which support may be the same as described for the light-sensitive film material.

The binder of the image-receiving layer containing developing nuclei in dispersed state may be any of the common hydrophilic binders used in the art, e.g. gelatin, carboxymethylcellulose, gum arabic, sodium alginate, propylene glycol ester of alginic acid, hydroxyethyl starch, dextrine, hydroxyethylcellulose, polyvinylpyrrolidone, polystyrene sulphonic acid, polyvinyl alcohol, etc.

It is preferred to use silver sulphide nuclei though other development nuclei can be used as well, e.g. sulphides of heavy metals such as sulphides of antimony, bismuth, cadmium, cobalt, lead, nickel and zinc. Other suitable salts are selenides, polyselenides, polysulphides, mercaptans and tin(II) halides. The complex salts of lead and zinc sulphides are active both alone and when mixed with thioacetamide, dithiobiuret and dithio-oxamide. Fogged silver halides can also be used as well as heavy metals themselves in colloidal form; preferably silver, gold, platinum, palladium and mercury may be used.

The image-receiving layer may be hardened so as to improve its mechanical strength. Hardening agents for colloid layers include e.g. formaldehyde, glyoxal, mucochloric acid, and chrome alum. Hardening may also be effected by incorporating a latent hardener in the colloid layer, whereby a hardener is released at the stage of applying the alkaline processing liquid.

Further information on the composition of the image-receiving layer can be found in "Photographic Silver Halide Diffusion Processes" by Andre Rott and Edith Weyde—The Focal Press, London and New York (1972), p. 50–65.

For carrying out the silver complex diffusion transfer process it is common practice to incorporate the developing agent(s) into the light-sensitive silver halide emulsion layer and/or the image-receiving layer, or other water-permeable layers adjacent thereto.

The DTR-processing liquid applied in the present invention is consequently preferably originally an alkaline liquid containing no developing agents.

Suitable developing agents for the exposed silver halide are, e.g., hydroquinone and 1-phenyl-3-pyrazolidinone type-developing agents and likewise p-monomethylaminophenol. The developing or activating liquid used in the process for forming a silver image through the silver complex diffusion transfer process contains a silver halide solvent, e.g., a complexing compound such as an alkali metal or ammonium thiosulphate or thiocyanate, or ammonia. Alternatively or in addition such complexing compounds may be present in the image-receiving layer.

The diffusion transfer proceeds preferably with, or in the apparatus commercially available therefor and of which several types have been described in the already mentioned book of A. Rott and E. Weyde.

The reverse reading positive image obtained by the process of the invention is used for the contact-exposure of a positive-working lithographic printing plate. Such plate contains e.g. a photosensitive layer of a positive-working photoresist composition. Such photoresist compositions become more soluble in the photo-exposed area. Suitable positive working photoresist compositions are described e.g. by W. S. De Forest in his book "Photoresist Materials and Processes", Mc Graw-Hill Book Company (1975).

In the production of positive working photoresist layers suitable for use with the reverse reading positive images prepared according to the present invention preferably photosensitive compounds are used which on photoexposure obtain an improved alkali-solubility. Photosensitive o-quinone-diazides are preferred for that purpose.

Such compounds are described e.g. in the published German patent application (DE-OS) No. 2,810,463 and in the U.S. Pat. No. 3,201,239 relating also to the preparation of positive working lithographic printing plates and to be read thereof in conjunction herewith.

In the production of a photosensitive material for producing a lithographic printing plate, the positive working photoresist composition is applied to a lithographic support material.

The lithographic support materials can be any of those well known in the art such as zinc, anodized aluminium, grained aluminium, copper and specially prepared metal and paper supports, partially hydrolyzed cellulose ester films, polymer supports such as polyolefins, polyesters, polyamide, etc.

The light-sensitive resist layers can be exposed by using conventional techniques to actinic radiation which is preferably in the ultraviolet range. The exposed elements are then developed by washing, soaking, swabbing, or otherwise treating the light-sensitive layers with a solvent or solvent system which acts on the modified exposed areas and removes these areas which have been made more soluble by the action of light. These developing solvents can be organic or aqueous in nature and will vary depending on the composition of the light-sensitive layer being developed. Examples of developing solvents include water, aqueous acids and alkalis, lower alcohols and ketones, and aqueous solutions of lower alcohols and ketones. The images formed can then be treated in any known manner dependent upon the intended final use.

The process for preparing a lithographic printing plate according to the present invention proceeds by the steps of (1) contact-exposing a positive working photosensitive resist layer carried on a lithographic support through the image-receiving material containing the reverse reading positive line and/or halftone image prepared according to the present invention with the silver image-bearing side of the image-receiving material in contact with the positive working photosensitive resist layer, (2) developing the resist layer by selectively removing the exposed areas with a solvent therefor to uncover the lithographic support in these areas.

The present invention is illustrated by the following example. All percentages and ratios are by weight unless otherwise stated.

EXAMPLE

Preparation of a photosensitive film material A with the antihalation layer on the rear side of a transparent support To a washed gelatino silver chlorobromide emulsion (98.2 mole % of chloride and 1.8 mole % of bromide) a spectral sensitizing agent for offering orthochromatic sensitivity, common stabilizing agents, and hydroquinone and 1-phenyl-4-methyl-3-pyrazolidinone as developing agents were added. The coating of the emulsion onto a transparent polyethylene terephthalate support on both sides proceeded in such a way that the silver halide was present at a coverage equivalent with 2.5 g of silver nitrate per sq.m. The weight ratio of gelatin with respect to the silver halide expressed as silver nitrate was 1.2. Hydroquinone and 1-phenyl-4-methyl-3-pyrazolidinone were present at a coverage of 0.90 g and 0.25 g per sq.m respectively.

An antihalation layer composed of gelatin and carbon black was applied. The coating of that layer proceeded in such a way that the optical density for visual filter light measured with a MACBETH (registered trade mark) TD 102 densitometer after drying was 0.6. "Visual filter"-light is light having a spectral range distribution approximately characteristic for the human eye sensitivity. The weight ratio of gelatin to carbon black was 32/1.

Preparation of a photosensitive film material B having the antihalation layer between the silver halide emulsion layer and a transparent support The preparation of material B was the same as described for the preparation of material A with the difference, however, that the emulsion was applied to the antihalation layer and no further antihalation layer was applied.

Image-receiving material

The image-receiving material used in conjunction with the above photosensitive film materials in diffusion transfer reversal (DTR-) processing was prepared by coating a subbed polyethylene terephthalate film support with an aqueous colloidal dispersion containing 11% of gelatin and 0.2% of silver sulphide development nuclei. The obtained dispersion was coated at a gelatin coverage of 2.5 g per sq.m and dried.

Exposure and processing

The photographic materials A and B were exposed to a continuous tone black-and-white original for direct screening with a contact screen using a vertical dark-room camera without reversing optical system, i.e. without reversing mirror or prism. The exposure proceeded with the emulsion side facing away from the camera lens, the light therefrom thus passing through the support and antihalation layer before impinging upon the emulsion layer. Hereby in DTR-processing a right-reading negative was obtained on the photosensitive film materials and a reverse reading positive print on the image-receiving material.

After the exposure the materials A and B were introduced each in contact with separate sheets of the above-described image-receiving material into a diffusion transfer processing apparatus containing a liquid of the following composition:

| | |
|---|---|
| water | 800 ml |
| tribasic sodium phosphate.12 $H_2O$ | 75 g |
| anhydrous sodium sulphite | 40 g |
| potassium bromide | 0.5 g |
| anhydrous sodium thiosulphate | 20 g |
| 1-phenyl-5-mercaptotetrazole | 70 mg |
| water to make | 1000 ml |

When the sandwich of each light-sensitive material and image-receiving material left the squeezing rollers of the diffusion transfer apparatus, the materials were still kept in contact for 60 s and then separated from each other.

The screen dots of the reverse reading positive print obtained on the image-receiving material with photosensitive film material A had a sharpness somewhat inferior to that obtained with film material B.

Both prints were applied in the production of a positive right reading lithographic offset printing plate.

The above-described materials A and B and image-receiving material were likewise perfectly suited for the reproduction of line originals which are reproduced without screening exposure.

We claim:

1. Process for preparing an offset lithographic printing plate comprising a lithographic support carrying a positive working photosensitive resist layer which comprises the steps of:

(1) photo-exposing to an original, in a camera without a reversing optical means, a negative working photographic material comprising a negative working silver halide emulsion layer on a transparent film support and an antihalation layer either between the emulsion layer and the film support or at the side of said support opposite to that carrying the emulsion layer, said material being disposed with its support facing the camera during said exposure which thus takes place through said support and when said original is a continuous tone original said exposure also being effected through a screen, (2) bringing the exposed emulsion layer side of said photographic material into contact with an image-receiving material comprising a transparent support carrying an image-receiving layer containing developing nuclei in the presence of at least one developing agent, an aqueous alkaline liquid for development of the exposed silver halide, and of a silver halide complexing agent to effect the transfer by the diffusion of complexes of unexposed silver halide from the photographic material into the image-receiving layer to form a visible silver image therein, (3) separating the exposed photographic material from said image-receiving material, (4) contact-exposing said photosensitive resist layer through the silver image carrying image-receiving material from step (3) while the silver image bearing side of said material is in contact with said resist layer, and (5) developing said exposed resist layer by selectively removing the exposed areas thereof with a solvent therefor to uncover the lithographic support in these areas.

2. Process according to claim 1, characterized in that the antihalation layer contains carbon black.

3. Process according to claim 1, characterized in that the antihalation layer has an optical density not larger than 0.9 and not lower than 0.3.

4. Process according to claim 3, characterized in that the antihalation layer has an optical density in the range of 0.6 to 0.5.

5. Process according to claim 1, characterized in that the transparent support of each of the photographic material and of the image-receiving material is a polyethylene terephthalate support provided at both sides thereof with a subbing layer.

6. Process according to claim 1, characterized in that the antihalation layer of said photographic material is disposed between the support and the silver halide emulsion layer.

7. Process according to claim 1, characterized in that the silver halide emulsion layer incorporates at least one of said developing agents in step (2) and said aqueous alkaline liquid is originally an alkaline liquid containing no developing agent.

* * * * *